US005131186A

United States Patent [19]

Lamont

[11] Patent Number: 5,131,186

[45] Date of Patent: Jul. 21, 1992

[54] PORTABLE SECURITY GRILL APPARATUS

[76] Inventor: Tim Lamont, 4524 Albion Dr., Riverside, Calif. 92503

[21] Appl. No.: 729,222

[22] Filed: Jul. 12, 1991

Related U.S. Application Data

[63] Continuation-in-part of Ser. No. 372,839, Jun. 29, 1989.

[51] Int. Cl.[5] ..... E06B 3/68

[52] U.S. Cl. ..... 49/57; 49/55; 49/465

[58] Field of Search ..... 49/55, 57, 61, 465, 49/449, 394; 292/205, DIG. 31, DIG. 49; 70/148

[56] References Cited

U.S. PATENT DOCUMENTS

| | | | |
|---|---|---|---|
| Re. 19,617 | 6/1935 | Van Dresser | 49/55 X |
| 1,415,104 | 5/1922 | Meyer | 49/394 X |
| 1,570,611 | 1/1926 | Calhoun | 292/205 X |
| 2,459,884 | 1/1949 | Kopf | 49/57 X |
| 2,594,864 | 4/1952 | Buckland et al. | 49/57 X |
| 2,655,395 | 10/1953 | Groeger | 292/205 X |
| 2,803,074 | 8/1957 | Brokish | 49/55 X |
| 2,896,277 | 7/1959 | Halligan | 49/465 |
| 2,928,146 | 3/1960 | Kuniholm | 49/465 |
| 4,312,204 | 1/1982 | Davis | 292/DIG. 31 |
| 4,437,265 | 3/1984 | Turro et al. | 49/57 |
| 4,671,012 | 6/1987 | Merkinger et al. | 49/55 |

FOREIGN PATENT DOCUMENTS

| | | | |
|---|---|---|---|
| 2357660 | 5/1975 | Fed. Rep. of Germany | 49/55 |
| 2601342 | 1/1977 | Fed. Rep. of Germany | 49/394 |
| 2806621 | 8/1979 | Fed. Rep. of Germany | 49/394 |

*Primary Examiner*—Renee S. Luebke
*Assistant Examiner*—Jerry Redman
*Attorney, Agent, or Firm*—Plante, Strauss & Vanderburgh

[57] ABSTRACT

A portable security grill apparatus which may be installed in window openings of buildings includes two rectangular grill sections longitudinally telescopically fastened to one another. Opposite longitudinal ends of the two grill sections have beams disposed perpendicularly to the axis of longitudinal telescoping movability of the two grill sections, the beams having flat outer surfaces adapted to abut a window edge at one end of the grill apparatus, and a window frame edge, at the other end of the apparatus. At least one toggle clamp connected between telescopically joined members of the two grill sections is capable of exerting a large outward extension force when in a closed, clamped position, thereby exerting compressive forces on the window and window frame sufficient to prevent the grill apparatus from being removed from the window opening.

14 Claims, 4 Drawing Sheets

PORTABLE SECURITY GRILL APPARATUS

REFERENCE TO RELATED APPLICATIONS

This application is a continuation-in-part of my copending application Ser. No. 07/372,839, filed on June 29, 1989.

BACKGROUND OF THE INVENTION

A. Field of the Invention.

The present invention relates to apparatus for preventing unauthorized entry into buildings via window openings. More particularly, the invention relates to a portable apparatus which may be installed in a window opening to permit air and light to enter a building, while preventing persons from entering the building through the window opening.

B. Discussion of Background Art.

It is an unfortunate fact that the crime rate in our country is on the increase. Thus, many individuals who because of their geographic location, away from high crime rate areas, or for other reasons, felt themselves immune from the crime problem, must now confront one manifestation of that problem; namely the ever-increasing rate of business and residential burglaries.

Most rational individuals would not wish the material fruits of their labors to be stolen from them by burglars. More importantly, most people are genuinely concerned that those criminals who would break into their dwelling places or residences to steal their possessions often are the type of individuals who would just as soon kill or injure the owner or his loved ones, should they be present during the course of a burglary.

As a result of their concern for the protection of their property, and the lives of themselves and their loved ones, a substantial percentage of the population have begun to take measures to protect themselves from burglars. For example, many homeowners and business owners have installed more secure door locks, and burglar alarms in their homes and shops. Another form of protection which has found increasing favor are security bar devices which, when installed over window openings or doorways, provide a very effective barrier to unauthorized entry through the protected opening. Such security bar devices generally take the form of a grill comprising a parallel array, or lattice array of heavy metal bars which are spaced closely enough to prevent passage through the array by a person.

Security bar devices of the type described above generally provide an effective means of preventing undesired entry to buildings through the protected areas. However, most such security bar device suffer from one or more disadvantages which limit their wider usage. For example, many older security bar devices are not equipped with a safety mechanism which permits escape of the building occupants in the case of fire or other accidents within the building, or the entrance of firemen or other emergency personnel. Unfortunately, the absence of such a safety release provision in some security bar devices has resulted in the tragic loss of life.

Although there are now available security bar devices that are provided with safety release mechanisms, these as well as the older type security bar devices have an inherent feature which limits their more widespread usage. Specifically, most available security bar devices are relatively heavy and costly, and are intended for relatively permanent, and correspondingly costly, installation. Accordingly, such security bar devices are generally unsuitable for people who rent, or have limited incomes. Some devices have been disclosed which would seem to address the problem of providing a security bar device which might be usable in non-permanent installation applications. Typical of such disclosures are those contained in the following U.S. Pat. Nos.:

Iyersen, 4,757,465, Mar. 18, 1986, Security Grill Apparatus for Doors and Windows.

Zilkha, 4,624,072, Nov. 25, 1986, Adjustable Security Window Gates.

Merklingen, et al., 4,671,012, June 9, 1987, Security Barrier.

Jokel, 4,680,890, July 21, 1987, Window Intrusion Barrier.

The present invention was conceived of to provide a security grill apparatus which is highly portable and useable in window openings of various dimensions.

OBJECTS OF THE INVENTION

An object of the present invention is to provide a portable security grill apparatus which may be readily installed in a window opening, while providing an effective bar to entrance by individuals through the window opening.

Another object of the invention is to provide a portable security grill apparatus for windows which is readily adjustable to fit within various height spaces between a window sill and the bottom of a raised window.

Another object of the invention is to provide a portable security grill apparatus for windows which may be quickly and securely clamped into a compressively locking contact between parallel structural members, such as the lower surface of a raised window and the upper surface of a window sill.

Another object of the invention is to provide a portable security grill apparatus for windows which may be optionally secured in locking position with a key lock, after being compressively locked into position.

Another object of the invention is to provide a portable security grill apparatus for window openings which may be quickly unlocked and removed from a window opening.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention be limited to details of the embodiments described. I do intend that equivalents, adaptations and modifications of the invention, reasonably inferable from the description contained herein be included within the scope of the invention as defined by the appended claims.

SUMMARY OF THE INVENTION

Briefly stated, the present invention comprehends a portable security grill apparatus for removable installation in openings in the walls of structures such as shops, industrial buildings, and dwelling places such as homes and apartments. The apparatus according to the present invention is particularly well adapted to removable installation in window frames with the window slid to an open upper or side position. The apparatus prevents unauthorized entrance through the window opening, while allowing the window to be open for ventilation purposes, and allowing light to enter the room protected.

The portable security grill apparatus according to the present invention includes a grill comprising a plurality of regularly spaced horizontally disposed rigid metal bars, welded to a plurality of vertically disposed, hollow rigid metal bars. The lower ends of the vertical bars are fastened to a horizontally disposed, flat lower beam adapted to seat firmly against the upper surface of a window sill. The upper ends of each of the hollow vertical bars slidably contains a shorter steel bar. Each of the upper ends of the shorter steel bars is in turn attached to the bottom of a horizontally disposed, flat upper beam adapted to seat firmly against the lower surface of an open window, or window frame.

At least one toggle clamp mechanism is connected between a slidable steel bar and the hollow steel bar in which it is positioned. When the toggle clamp mechanism is compressed into its closed position, the slidable steel bar is forced upwards with respect to the hollow steel tube to which it is joined by the toggle clamp mechanism. Thus, closing the toggle clamp forces a slidable steel bar to move telescopically upwards, moving the upper beam upwards.

Means are included within the toggle clamp mechanism to adjust the amount of upward travel of the upper beam. Also, the toggle clamp mechanism is so constructed as to have a substantial mechanical force advantage. Therefore, a substantial compressive force may be exerted between the upper and lower window frame members when the toggle clamp is closed. That force is sufficiently large to preclude pulling the security bar apparatus from the window frame, without releasing the toggle clamp operating lever. Since this lever is located inside the structure protected, it is not accessible to an intruder. In the preferred embodiment of the apparatus, a key lock is attached to the toggle clamp, permitting release cf the toggle clamp lever only by first inserting a key and turning the key lock to an unlocked position.

DESCRIPTION OF THE PREFERRED EMBODIMENTS

Figure 1:
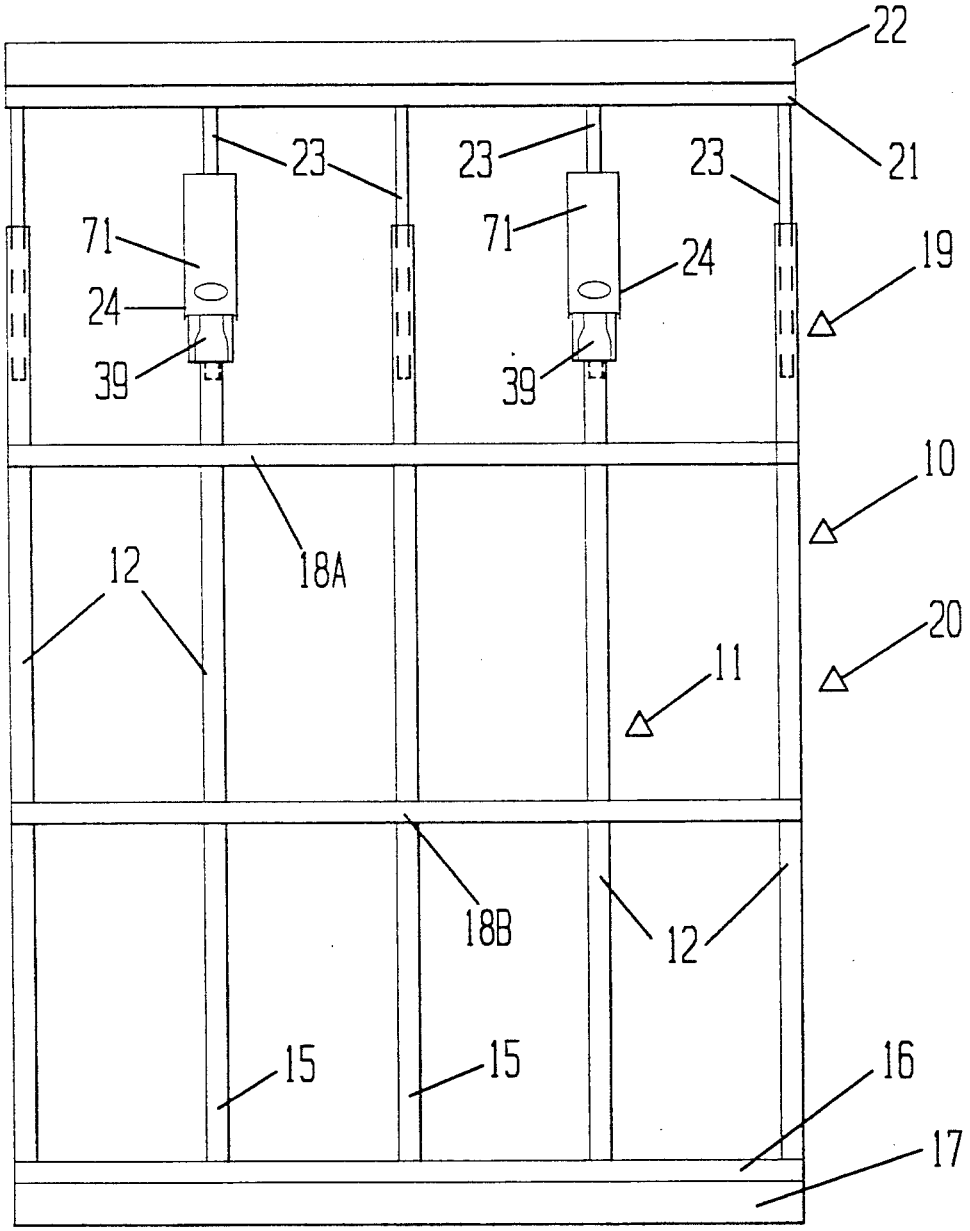
FIG. 1 is an inside elevation view of the security grill apparatus according to the present invention, showing the apparatus installed in a window opening.

Referring now to FIGS. 1 through 5, a portable security grill apparatus 10 is shown. As shown in FIG. 1, the apparatus 10 is vertically positioned for installation in a window frame with a vertically slidable window in its upper position. However, the apparatus may also be horizontally oriented for installation in a window frame having a horizontally slidable window.

As shown in FIG. 1, the security grill apparatus includes a grill 11 having a plurality of elongated straight rigid metal bars 12. Bars 12 are arranged in vertically disposed parallel positions, at regular horizontal intervals, and all lie in a common plane.

Figure 2:
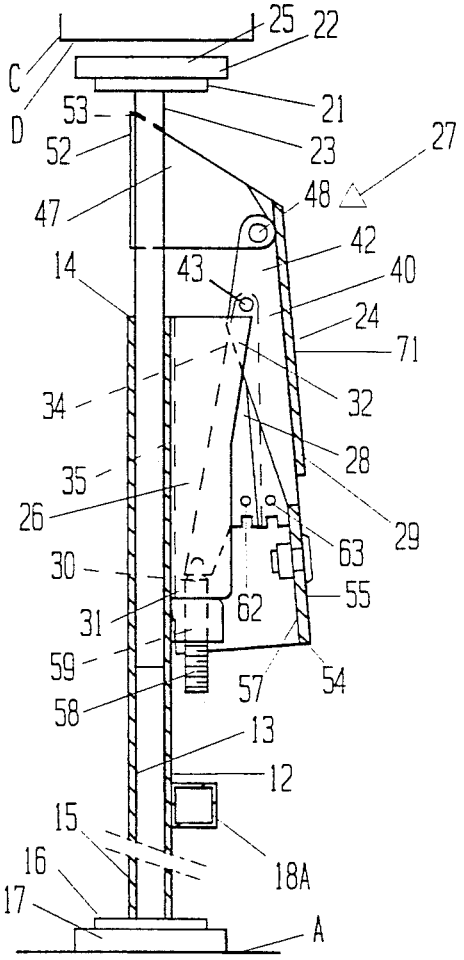
FIG. 2 is a fragmentary side elevation view of the apparatus of FIG. 1, on a somewhat enlarged scale, showing the apparatus in a retracted position.
Figure 3:
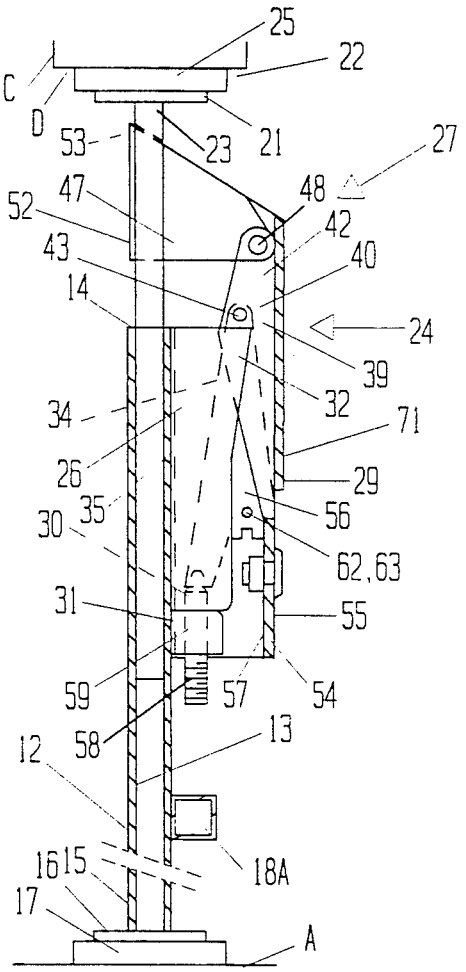
FIG. 3 is a view similar to FIG. 2, but showing the apparatus in an extended position.

As may be seen best by referring to FIGS. 1, 2 and 3, at least the upper end of each of the bars 12 contains a hollow coaxial bore 13 extending longitudinally inward some distance from the upper transverse face 14 of the bar 12. Preferably, bars 12 are fabricated from square cross-section, hollow steel tubes. When so fabricated, bore 13 has a square cross-sectional shape, and extends through the entire length of a bar 12.

The lower transverse ends 15 of bars 12 are welded or otherwise secured to a flat, elongated rectangular base plate 16 made of steel or other rigid material. The lower surface of base plate 16 is fastened in flush contact with a flat, elongated rectangular wooden base beam 17. Base beam 17 has a flat bottom, and is of approximately the same width as, but of slightly greater depth than, base plate 16. Base beam 17 is secured to base plate 16 by screws, adhesive, or any other suitable means.

As may be seen best by referring to FIG. 1, grill 11 of security grill apparatus 10 includes a plurality of elongated, straight rigid metal cross bars 18, such as upper bar 18A and lower bar 18B. Cross bars 18 are arranged in horizontally disposed parallel positions, at regular vertical intervals. The cross bars 18 are welded to the front, or inner surface of vertical bars 12, thus forming therewith a rigid, planar grill structure. Cross bars 18 may be fabricated from the same type of steel tubing as vertical bars 12, if desired.

As may be seen best by referring to FIG. 1, grill 11 of security bar apparatus 10 includes an upper section 19 of smaller height than the lower section 20 described above. Upper section 19 is vertically telescopable with respect to lower section 20 of the grill 11, in a manner which will now be described.

As shown in FIGS. 1, 2 and 3, the vertically telescopable upper section 19 of grill 11 includes an upper elongated rectangular flat steel roof plate 21, which is substantially identical to base plate 16, and is positioned in a parallel, overlying position with respect to the base plate. Also, upper section 19 of grill 11 includes an elongated, flat rectangular wooden roof beam 22, which is substantially identical to base beam 17. In a construction exactly similar to that of base beam 17 and base plate 16, roof beam 22 is attached to the upper surface of roof plate 21.

As may be seen best by referring to FIG. 1, upper telescopable section 19 of grill 11 includes a plurality of straight, relative short metal bars 23. Short metal bars 23 are fastened to steel roof plate 21, and extend perpendicularly downwards from the roof plate. The short metal bars 23 have smaller outer cross-sectional dimensions than the corresponding dimensions of the bores 13 in long vertical bars 12. Also, the horizontal spacing and positioning of short bars 23 are of the proper dimensions to permit the upper section 19 of grill 11 to move up and down vertically with respect to lower section 20 while maintaining the upper and lower sections in secure horizontal positions relative to one another, with the upper roof beam 22 in parallel alignment with the lower base beam 17.

As shown in FIG. 1, at least one toggle clamp mechanism 24 is operatively interconnected between the upper portion of a hollow vertical tube 12 and a short vertical bar 23 which is telescopically slidably located within the bore 13 of the vertical bar 12. Preferably, security bar apparatus 10 includes two such toggle clamp mechanisms 24, spaced at equidistant intervals from the lateral sides of the grill 11.

The structure and operation of toggle clamp mechanism 24 may be best understood by referring to FIGS. 2, 3, 4 and 5. FIG. 2 illustrates the toggle clamp mechanism 24 in an open position, in which the short metal bars 23 are in a downward, retracted relationship relative to the lower vertical bars 12. In this position, with the lower surface of base beam 17 resting on the upper surface A of a window frame, the upper surface 25 of roof beam 22 is positioned below the lower surface D of a raised window C.

As shown in FIGS. 2, 3, 4 and 5, the toggle clamp mechanism 24 includes a channel frame section 26 which is fastened to an outer vertical surface of a lower rigid vertical bar 12. The toggle clamp mechanism 24 also includes a multi-component lever mechanism 27 which is vertically slidably attached to the channel frame section 26, and pivotally attached to a short vertically disposed, metal upper bar 23, the latter being vertically slidable within the bore 13 of lower tubular bar 12.

As shown in FIGS. 2, 3, 4 and 5, the lever mechanism 27 of toggle clamp mechanism 24 includes a base plate 28, an operating arm 39, and an engagement lug 30. The base plate 28 of lever mechanism 27 is vertically slidably supported within channel frame section 26, as will now be described.

Channel frame section 26 has a tubular lower end 31 of relatively short length, t@e major, upper portion of the channel frame section 26 having the shape of a vertically elongated, open U-shaped channel 32. The opposite upper edges of the side walls of channel 32 flare inward to form opposed laterally spaced-apart, longitudinally disposed parallel flanges 33 (see FIG. 5). Base plate 28 has a generally uniform thickness, and has in elevation view the approximate shape of a vertically elongated trapezoid. The inner vertical surface 34 of base plate 28 is flat and adapted to move slidably on the bottom surface 35 of channel 32 of channel frame section 26. Near the bottom end of base plate 28, are rounded bosses 36 (see FIG. 5) which project perpendicularly outward from the front and rear vertical surfaces 37 and 38, respectively, of base plate 28. The lateral distance between the outer surfaces of bosses 36 is greater than the distance between the inner facing wall surfaces of flanges 33 of channel frame section 26. Thus, base plate 28 is vertically slidable within channel 32 in channel frame section 26, but prevented from moving laterally out of the channel by contact of bosses 36 with flanges 33.

As shown in FIGS. 1 through 5, the lever mechanism 27 of toggle clamp mechanism 24 includes an outer lever arm 39. Lever arm 39 is an elongated member having an upper channel-shaped portion 40 having front and rear side walls 41 and 42 (see FIG. 5) formed therein. The lateral spacing between the inner surfaces of front and rear side walls 41 and 42 of upper channel section 40 of lever arm 39 is slightly larger than the thickness of base plate 28 of lever mechanism 27. This difference permits the upper end of base plate 28 to reside pivotally within channel section 40 of lever arm 39. The pivotal joint between base plate 28 and lever arm 39 consists of a pivot pin 43 which extends through registered holes and in the front and rear sidewalls 41 and 42, respectively, of upper channel section 40 of the lever arm. Pivot pin 43 is located about one-fifth of the longitudinal distance between the upper and lower ends of the lever arm 39.

The upper end of lever arm 39 includes a generally trapezoidal or triangular shaped lug 47 of generally uniform thickness, pivotally held between the front and rear walls 41 and 42 of the lever arm. The inner, smaller vertex or base of lug 47 is pivotally attached within the upper channel section 40 of lever arm 34 by means of a pivot pin 48 fastened in holes 49 and **5*d* in the front and rear walls, and passing through a clearance hole 51 through the lug. The larger, base section 52 of lug 47 is positioned within a mating slot 53 in the upper end of slidable upper vertical bar 23**.

The lower end of lever arm 39 has a generally flat plate-like handle section 54. Plate-like handle section 54 has a flat outer lateral surface 55. Plate-like handle section has a generally rectangular plan-view shape and is joined near its upper end to the lower ends of front and rear side walls 41 and 42 of upper channel section 40 of the lever arm 39, perpendicular thereto. A generally uniform-thickness locking tab 56 having a generally triangular-shaped plan-view is fastened to the inner wall surface of the lower end of front side wall 41 of upper channel section 40. Locking tab 56 lies in a vertical plane and extends perpendicularly inward from the inner wall surface 57 of plate-like lower handle section 54.

As may be seen best by referring to FIGS. 2 and 3, lever arm 39 may be pivoted in a vertical plane with respect to channel frame section 26 of toggle clamp mechanism 24, about intermediate pivot pin 43. As shown in FIG. 3, downward and inward pivotal motion of lever arm 39 relative to channel frame section 26 and attached lower tubular vertical bar 12 moves lug 47 upwards. This in turn moves upper vertical bar 23, which is engaged by lug 47 via the slot 53 in the upper vertical bar 23, upwards with respect to the lower tubular 12. Thus, as shown in FIGS. 2 and 3, base beam 17 and roof beam 22 are spread apart vertically, allowing a compressive force to be exerted on window frame A and window C. Owing to the fact that the ratio of the distance between the lower end of handle section 54 and intermediate pivot pin 43 on the one hand, and the distance between the intermediate pin 43 and upper pivot pin 48, on the other, is about 5 to 1, a substantial, locking compressive force may be exerted which requires only a modest closing force on handle section 54. This force can be sufficiently great to render the removal of the security bar apparatus 10 from a window frame a virtual impossibility unless the window and/or frame are destroyed.

As shown in FIGS. 2 through 5, a threaded stud 58 is contained in a threaded bore 59 in lower tubular end 31 of channel frame section 26. The upper end 60 (see FIG. 5) of the threaded stud abuts the lower end 61 of base plate 28 of lever mechanism 27, thus permitting the lower limit of motion of the base plate to be adjusted to a desired value. Thus, turning threaded stud 58 permits adjusting the locked and unlocked vertical extension of security bar apparatus 10 to fit various size window openings.

As shown in FIG. 2, the lower end of base plate 28 and locking tab 56 are provided with through holes 62 and 63, respectively. Holes 62 and 63 are equal distances from intermediate pivot pin 43. Thus, with the toggle clamp mechanism 24 in a locked position, as shown in FIG. 3, holes 62 and 63 are in a registered position, permitting a locking member, such as the hasp of a conventional combination or key lock, to be inserted through the holes.

Figure 4:
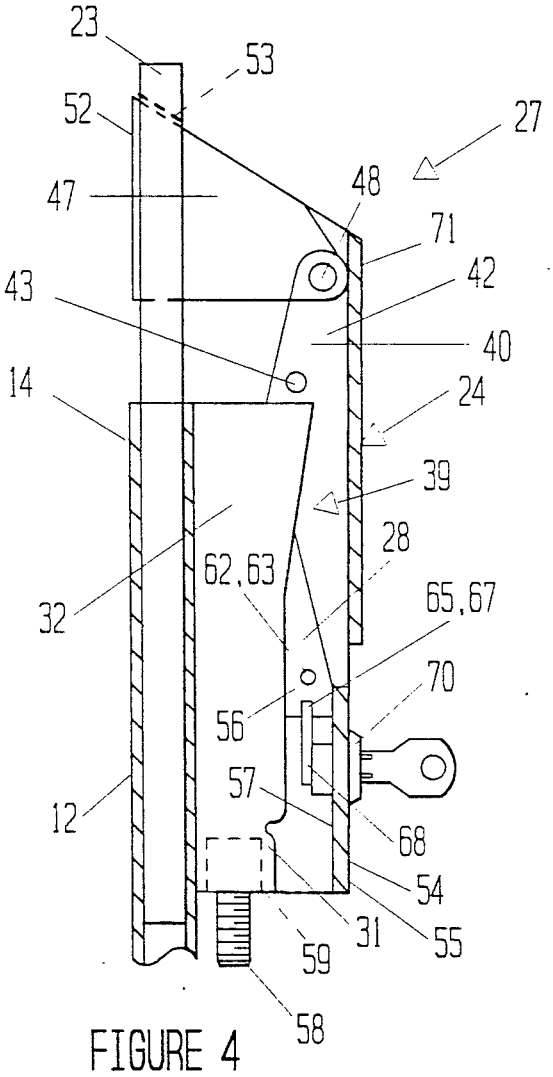
FIG. 4 is a fragmentary side elevation view of the apparatus of FIG. 1, showing the toggle clamp mechanism in a closed and locked position.
Figure 5:
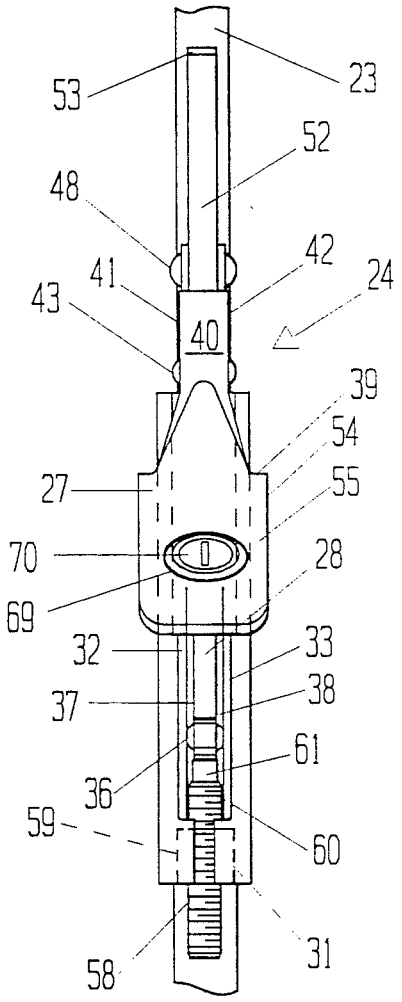
FIG. 5 is a fragmentary front elevation view of the apparatus of FIG. 4, showing the lever of a toggle clamp forming part of the apparatus pivoted into an upward position.

As may be seen best by referring to FIGS. 1 and 4, the upper portion of each toggle clamp mechanism 24 is preferably concealed by means of a U-channel-shaped cover 71 which is fastened to the outer wall of upper channel-shaped portion 40 of lever arm 39 by any convenient means.

Figure 6:
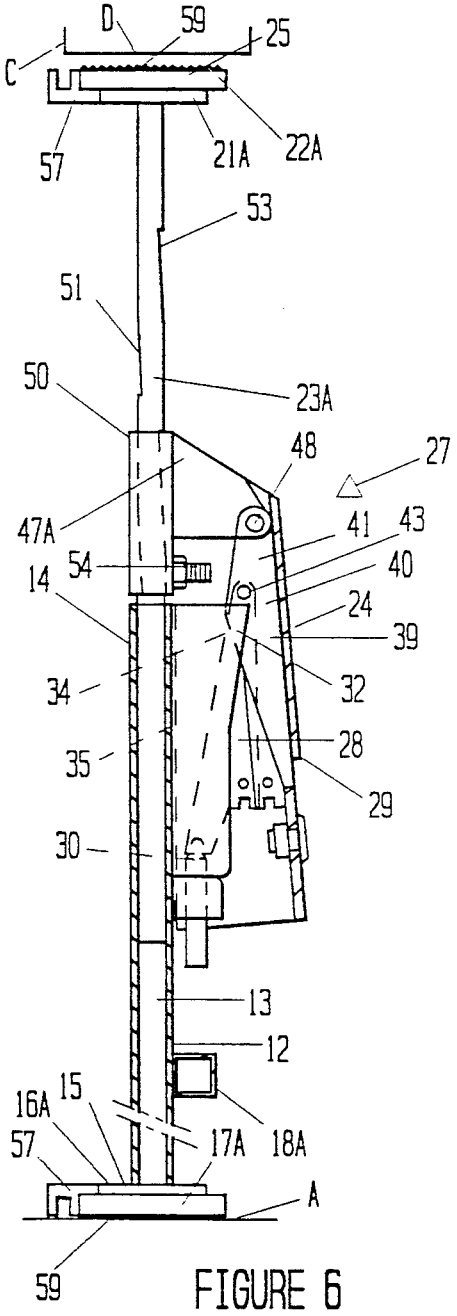
FIG. 6 is a fragmentary side elevation view of the apparatus showing a variation in the mechanism permitting expansion of the apparatus to fit varied window spans.
Figure 7:
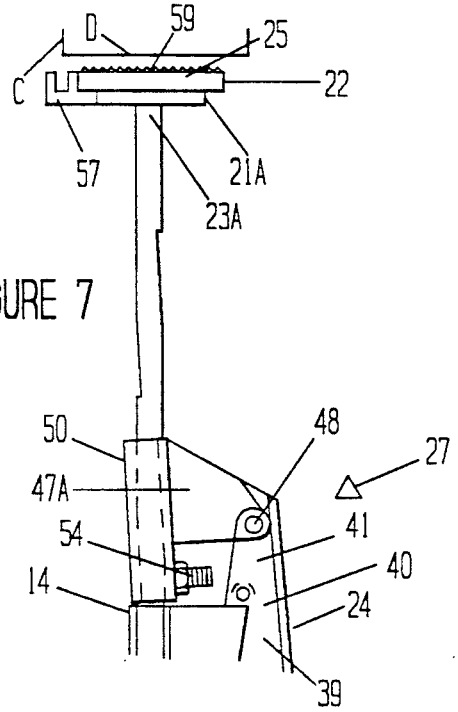
FIG. 7 is another fragmentary side elevation view showing the adjustment capability of the embodiment of FIG. 6.
Figure 8:
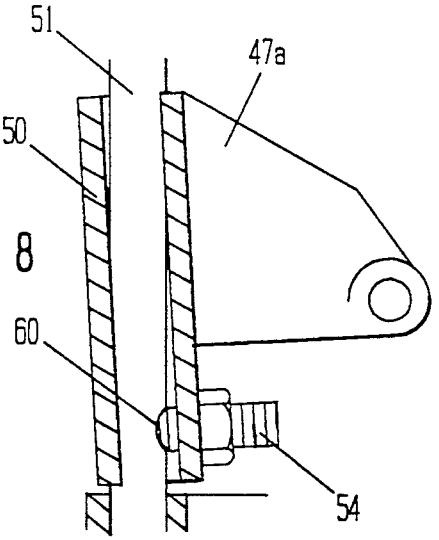
FIG. 8 an enlarged view of the area within line 8–8' of FIG. 7.

Referring now to FIGS. 6 through 8, an embodiment of the invention is shown with an alternative adjustable mechanism. The security device is substantially as previously described, and identical elements are identified with the same numbers as previously applied to FIGS. 1-5. At its upper end, the vertical bar 23A is telescopably received within bore 13 of bar 12. The vertical bar 23A has a plurality of notches 51 with angled forward edges, and a second plurality of notches 53 with angled rear edges. The lug 47A which is pivotally attached to the upper end of lever arm 39 fixedly supports a short square bar 50, which can be welded to the lug 47A.

The bar 50 has a set screw 54 threaded into its wall at its lower end. As shown in FIG. 6, when the set screw 54 is retracted, the bar 23A can be slid along the bar 50, thereby permitting adjustability in the span of the security grill device, since the bar 23A can be extended out of or retracted into the bar 12.

As shown in FIG. 7, the set screw 54 can be extended into bearing contact with the rear edge of the bar 23A, thereby tilting the bar 50 and firmly seating it in the lowermost set of notches 51 and 53 of the bar 23A.

As shown in FIG. 8, a recess 60 is preferably provided adjacent to each notch in the forward edge of bar 23A, and the set screw 54 seats in a recess 60.

Also shown in FIGS. 6 and 7 are a preferred base plate 16A and a preferred roof plate 21A. These plates preferably include fixedly dependent channels 57 along one longitudinal edge of each plate. The channels are useful for securing the device to metal frames which frequently have a metal rib along the sill and upper rail of each window.

Preferably, the base beam 17A and the roof beam 22A are formed of durable elastomers, such as rubber which most preferably have a roughened or textured surface 59 for firm gripping to the window frame members.

What is claimed is:

1. A security grill apparatus for removable installation in window openings comprising;

a. a first grill section comprising a plurality of spaced apart bars;

b. a second grill section having a second plurality of spaced apart bars including hollow form sections, each receiving a respective one of the bars of said first grill section, thereby providing a telescopically expandable assembly of said first and second grill sections;

c. a notched section of said first plurality of bars, including a plurality of inclined edge notches along opposite front and rear edges of said first plurality of bars; and d. clamp means including a short tube pivotally carried on said second grill section and surrounding and slidably receiving said notched section of said first plurality of bars, and means to cant said tube into alignment with said inclined edge notches, thereby fixedly securing said assembly at a preselected telescoping extension.

2. The apparatus of claim 1 including adjustable means on each said tubes to fixedly secure each said tube in a canted position, in registration with selected notches.

3. The apparatus of claim 2 wherein said adjustable means includes a set screw threadably received through a wall of said tube at one end thereof whereby extension of said set screw cants said tube.

4. The apparatus of claim 3 including a toggle clamp having a lever pivotally attached to said second grill section and supporting said tube pivotally mounted thereon, whereby said lever applies an extension force to said apparatus.

5. The apparatus of claim 2 wherein said first grill section includes longitudinally elongated, straight, laterally spaced apart parallel bars.

6. The apparatus of claim 5 wherein said second grill section includes longitudinally elongated, straight parallel hollow form bars longitudinally aligned with and telescopically receiving respective bars of said first grill section.

7. The apparatus of claim 6 wherein the ends of said parallel bars of said first grill section furthest away from said smaller grill section are coterminous.

8. The apparatus of claim 7 wherein said first grill section distally supports a first elongated base member having a flat outer edge.

9. The apparatus of claim 8 wherein the ends of said parallel members of said second grill section furthest away from said first grill section are coterminous.

10. The apparatus of claim 9 wherein said second grill section distally supports a second elongated base member having a flat outer edge.

11. The apparatus of claim 1 wherein said clamp means comprises at least one toggle clamp having a base plate including means for securing said base plate to one of said elongated parallel bars of said first grill section, and a lever mechanism pivotally attached to the base plate and supporting said tube whereby pivoting said lever mechanism towards said base plate moves said tube and elongated bars of said second grill section longitudinally outward with respect to said elongated bars of said first grill section.

12. The apparatus of claim 11 including locking means to lock said lever mechanism of said toggle clamp to said base plate when said lever mechanism is pivoted inward towards said base plate to a closed position.

13. The apparatus of claim 12 wherein said locking means comprises in combination holes through said base plate and said lever mechanism which are in registered positions when said clamp is in a closed position, whereby a locking pin may be inserted through said registered holes.

14. The apparatus of claim 12 wherein said locking means comprises in combination slots through an edge wall of said base plate and said lever mechanism which are in registered positions when said clamp is in a closed position, and a cylinder lock fastened to said clamp mechanism, said cylinder lock having a radially projecting lug adapted to engage both of said slots when said cylinder is rotated by means of a key inserted therein.

* * * * *